United States Patent [19]

Mathou

[11] 3,973,280

[45] Aug. 10, 1976

[54] SLIDING PANELS DISMOUNTABLE BED

[76] Inventor: Marcel Mathou, Zone Industrielle d'Onet le Chateau, 12000 Rodez, France

[22] Filed: Dec. 24, 1974

[21] Appl. No.: 536,209

[30] Foreign Application Priority Data

Dec. 28, 1973 France ..... 73.47036

[52] U.S. Cl. ..... 5/99 B

[51] Int. Cl.[2] ..... A47C 29/00

[58] Field of Search ..... 5/99 R, 99 B, 99 C

[56] References Cited

UNITED STATES PATENTS

| | | | |
|---|---|---|---|
| 2,573,526 | 10/1951 | White | 5/99 C |
| 2,574,079 | 11/1951 | White | 5/99 C |
| 2,774,081 | 12/1956 | Lukala | 5/99 B |

FOREIGN PATENTS OR APPLICATIONS

| | | | |
|---|---|---|---|
| 562,681 | 9/1923 | France | 5/99 B |
| 602,703 | 6/1948 | United Kingdom | 5/97 |

*Primary Examiner*—Paul R. Gilliam
*Assistant Examiner*—Andrew M. Calvert
*Attorney, Agent, or Firm*—Roylance, Abrams, Berdo & Kaul

[57] ABSTRACT

The assembly and disassembly of such a bed is provided by a resilient clamping of the tips 7 of the side panels B and D on the posts 4 of the head and foot panels A and C, while said side panels and said head and foot panels form a dihedral greater than 90°. The side panels are adjustable in height by means of a sliding movement of the tips 7 along the posts 4. The insertion of the mattress support S forbids any accidental disassembly of the bed.

6 Claims, 7 Drawing Figures

SLIDING PANELS DISMOUNTABLE BED

BACKGROUND OF THE INVENTION

The present invention relates to dismountable beds, in particular with sliding side panels. The invention more particularly relates to beds, in particular beds for children, in which the side panels, the head and foot panels and the matress support may be assembled or disassembled in a very simple and quick manner.

Several beds are already known in the prior art which comprise side panels, head and foot panels which may be taken to pieces. These beds however generally have many drawbacks as to the mode of assembling and disassembling the different panels. The assembly of these beds generally necessitates connecting elements such as bolts, screws, pins or drags, which often require the use of special tools to operate the assembly or disassembly of the panels. The assembly or disassembly steps are therefore often relatively uneasy and time consuming. Furthermore, the connecting elements conventionally used, and which are relatively complicated, do not present all the security qualities which could be expected, in particular as concerns an absolute impossibility of disassembly of the bed in the case the child which is in the bed would attempt, unconsciously or while playing, to dismantle the bed.

SUMMARY OF THE INVENTION

An object of the present invention is to provide a dismountable bed, in particular for children, the assembly and disassembly of which being extremely simple and quick.

An other object of the present invention is to provide a bed, the assembly and disassembly of which does not require any tool or particular connecting elements such as locking screws.

An other object of the present invention is to provide a child bed which is absolutely undismountable in the operative position for security reasons.

Still an other object of the present invention is to provide a bed for children with dismountable panels, the side panels of which are adjustable in height between at least a high position and a low position, through the sliding motion of the side panels along the posts of the head and foot panels.

Still an other object of the present invention is to provide a bed in which the sliding means for the side panels along the posts of the head and foot panels are also used as mounting and assembling means for the bed, and the matress support of which constitutes the squaring and the support means for the frame constituted by the panels.

Still an other object of the present invention is to provide a bed with dismountable panels, the matress support of which is easily adjustable in height.

According to the present invention, it is provided a bed comprising side panels, a head panel, a foot panel and a matress support. The lateral ends of the side panels comprise assembling tips provided to cooperate with the vertical posts of the head and foot panels, the steps of assembling and disassembling the tips with respect to the posts being such that they are impossible when the bed is in operative position, the panels forming a frame substantially rectangular, these steps being possible only when the frame formed by the head and foot panels and the side panels is deformed according to a parallelogram configuration, the tips being then disengageable from the posts, or on the contrary, being engageable on said posts.

DESCRIPTION OF THE DRAWINGS

Other features and advantages of the invention will become apparent during the course of the following description by reference to the accompanying drawings in which.

DESCRIPTION OF THE INVENTION

Figure 1:
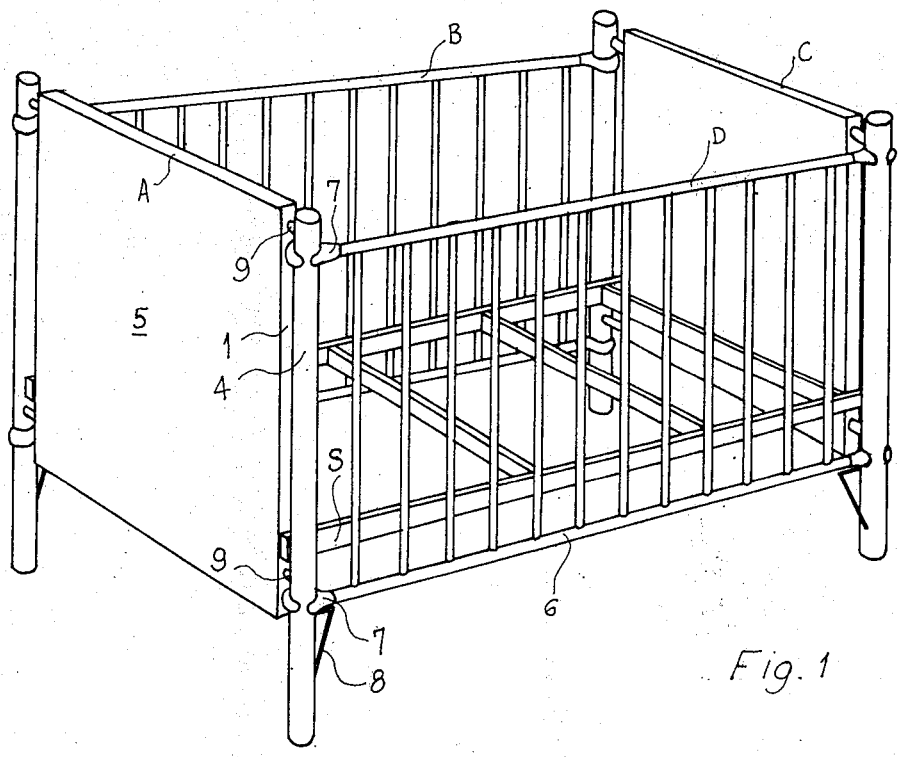
FIG. 1 is a perspective view of a preferred embodiment of a bed according to the present invention.

Now referring to FIG. 1, the bed according to the present invention, shown in a preferred embodiment, comprises a head panel and a foot panel A and C, two side panels generally identical B and D and a rectangular horizontal frame forming a matress support S. Each of the head and foot panels essentially comprises two vertical posts 4 and a cross-piece 5, an interval 1 being provided between the vertical post and the cross-piece 5, for instance by means of pegs 9, as shown. The function of these pegs 9 and interval 1 will be discussed later when studying the operation of the assembly. The side panels B and D generally comprise horizontal beams 6 supporting at their two opposite ends tips 7 provided for the assembly with the posts 4. In a preferred embodiment of the present invention, the assembly cooperation between the tips 7 and the posts 4 also enables the sliding of the side panels B and D along the vertical posts 4, said sliding being limited at the top, for example by the pegs 9 acting as stops for the tips 7 and said sliding being limited at the bottom by a supporting device, pins 8 for example made of spring steel and secured on the post 4 and supporting at their top end the tip 7 of the corresponding side panel in its high position.

Figure 2:
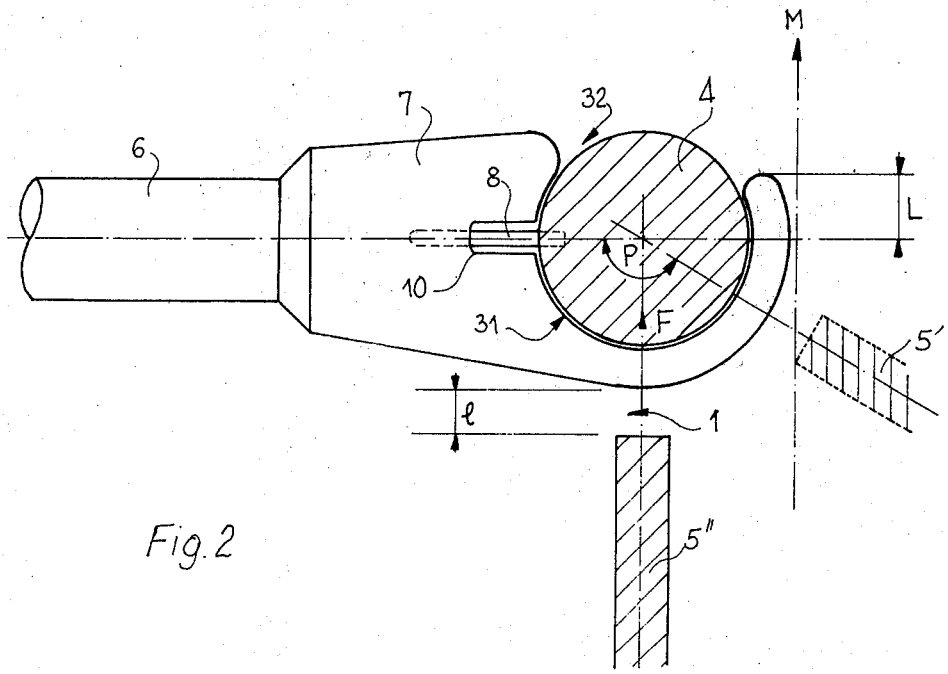
FIG. 2 is an enlarged top view partially in cross section of the assembly between a tip and a vertical post of an embodiment according to the present invention.

FIG. 2 shows a top view partially in cross-section of a preferred embodiment of assembly between the tips of the beams 6 of the side panels B and D and the vertical posts 4 of the head and foot panels A and C. The vertical posts 4 are generally circular in cross-section. Each beam 6 of the side panels comprises at the opposite ends a tip 7 which is secured by any known means, for example screwing, sticking, etc. . . . The tip 7 is preferably made of a resilient material, for example convenient plastic material, said tip comprising a substantially circular recess 31 having an aperture 32, the dimension of said aperture 32 being slightly less than the diameter of the circular section of the post 4, so that the assembly between the tip and the post can be obtained merely by clamping, upon application of a force in the direction of the arrow F for the assembly and in the opposite direction for the disassembly. It will be noted that the recess 31 of the tip 7 comprises a groove 10 for the passage of the pin 8 in the retracted position in order to allow the downward movement of the side panel along the vertical post 4.

Figure 3:
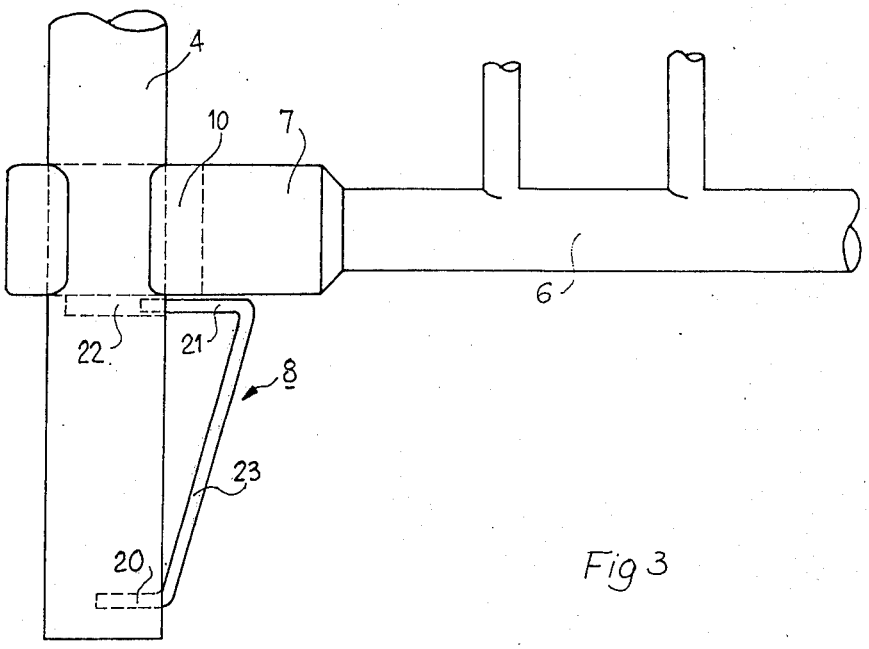
FIG. 3 is an elevational view showing a preferred embodiment for supporting and adjusting the side panels in height with respect to the vertical posts of the head and foot panels.

As clearly shown on FIG. 3, the pin 8 comprises a first bended end 20 secured in the post 4, and a second bended end 21 which can be resiliently pressed and therefore retracted with a sliding movement in the bore 22 provided in the post 4. It is clear that the tip 7 can slide down along the post 4 due to the groove 10 which enables the passage of the central part 23 of the pin 8 in its retracted position.

Figure 4A:
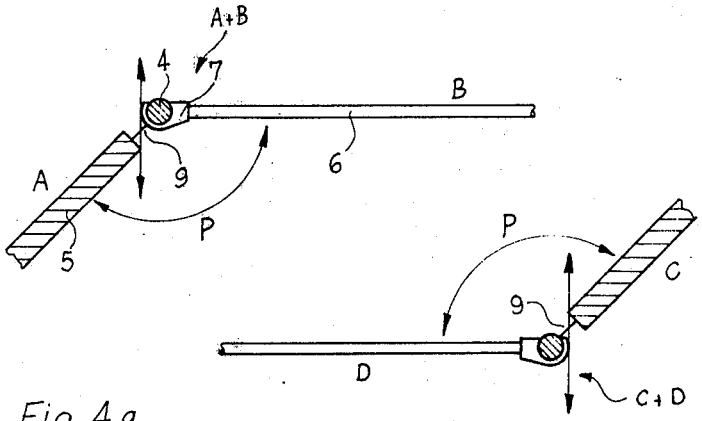
FIGS. 4*a* and 4*b* are diagrams showing the successive steps of the assembly and disassembly of the tips of the side panels with and from the posts of the head and foot panels as shown on FIG. 2.
Figure 4B:
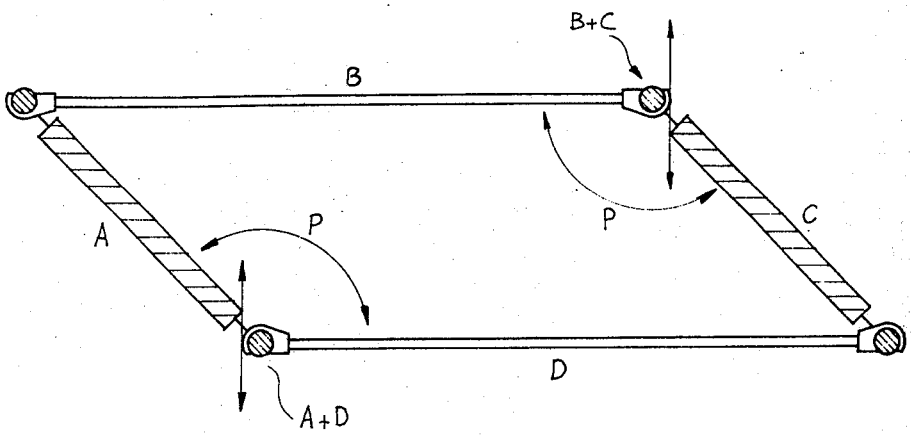

With reference to FIGS. 2, 4*a* and 4*b*, the assembly and disassembly of the bed of the present invention will now be described. These assembly and disassembly have the particular characteristic to be extremely quick and do not require for the complete assembly of the bed, including the set of the matress support, more than one minute and the disassembly is absolutely impossible as soon as the bed is in its operative position, that is to say when the frame, formed by the four panels preliminary assembled, is maintained in the square position by the rectangular matress support S inside the frame. This is very important for the security of employment of the bed according to the present invention.

In order to assemble, for example a side panel B with a head panel A, as schematically shown on figure 4*a*, it is necessary to clamp the tips 7 of the panel B on the post 4 of the adjacent panel A while the angle of the dihedral formed by the surfaces of the adjacent panels A and B is obtuse, as shown at P on FIGS. 2 and 4*a*. On FIG. 2, the cross-piece of the panel A is shown in dotted line in the position 5' of assembly or disassembly. It can be seen that in said position 5', the tip 7 can clamp with the post 4 due to the passage provided by the spaced position of the cross-piece. Said passage is delimited by the arrow M on FIG. 2. This panel A being assembled to one of the lateral ends of panel B, and panel C being secured to panel D, as shown in FIG. 4*a*, and panel B being secured to the other lateral end of panel C, and panel D being secured to panel A according to the process of FIG. 4*b*, the four panels of the bed are linked to each other and assembled according to a frame having the form of a parallelogram, as shown on FIG. 4*b*.

To end with the assembly of the bed, it is only necessary to put the parallelogram ABCD in the form of a rectangle. Looking back to FIG. 2, the position taken by the cross-piece 5 of the head or foot panel with respect to the tip 7 of the side panels, is then such as shown at 5'' in full line. It will be understood that it is therefore sufficient for the interval 1 of the FIG. 2, which is comprised between the end of the cross-piece 5 and the external surface of the corresponding tip 7, to be slightly less than the interval L for the engagement and disengagement of the tip 7 on the post 4, in order to make impossible the disengagement of the tip 7 from the post 4 due to the stop effect produced by the end of the cross-piece in the position 5'' with respect to the external surface of the corresponding tip 7. The introduction of the matress support S of a rectangular shape inside the rectangular frame formed by the four panels of the bed is sufficient to maintain the assembly.

Figure 5:
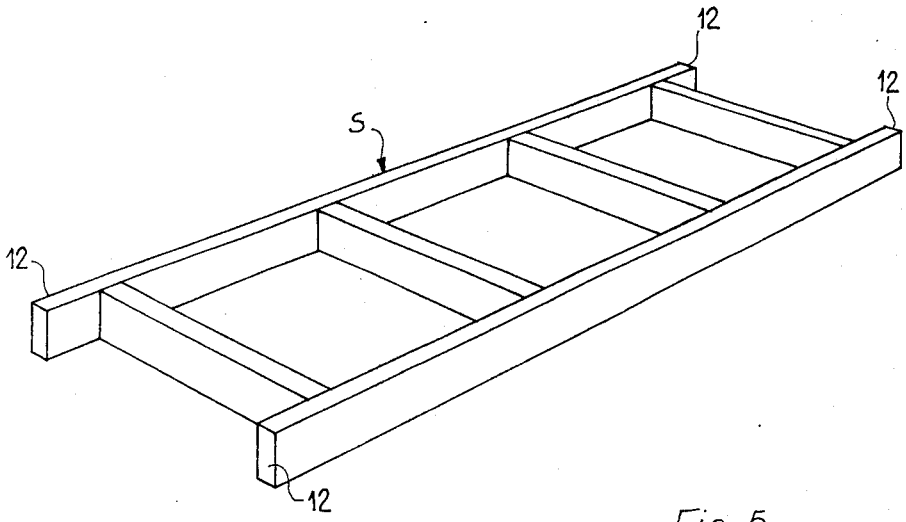
FIG. 5 is a perspective view of an embodiment of matress support.
Figure 6:
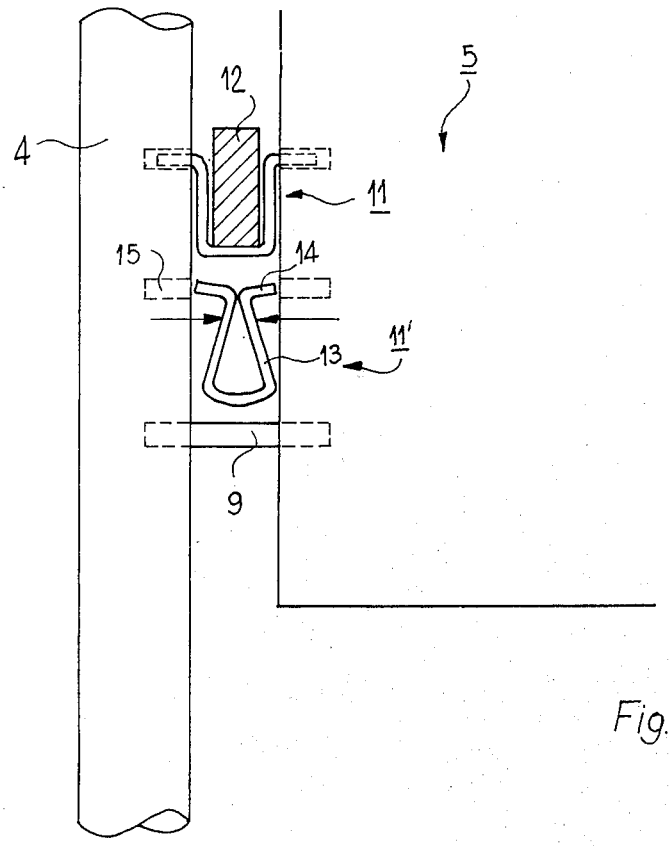
FIG. 6 is a partial elevational view showing a preferred embodiment of the device for supporting and adjusting in height the matress support with respect to the head and foot panels.

In a preferred embodiment of the present invention, the position of the matress support S is adjustable in height with respect to the posts 4 of the head and foot panels, as it will now be described. The matress support S of a generally rectangular form comprises for example end projections 12, as shown on FIG. 5. Said end projections are positioned, for example, in supporting elements such as those shown at 11 on FIG. 6. In a preferred embodiment, these supporting elements are substantially U-shaped, the ends of the arms comprising lateral projections 14. Said supporting elements are advantageously made of spring metal wire so that, when they are manually pressed as shown at 11' on FIG. 6, they can be moved in or away from pairs of appropriated holes 15 provided on one hand in the posts 4 and on the other hand in the cross-piece 5 of the head and foot panels. It will be easily understood that by the mere provision of series of pairs of holes, such as 15, regularly or irregularly spaced on the height of the posts 4 and the cross-piece 5, it will be possible to determine the desired height of the matress support.

It is therefore clear from the above description that the present invention provides a bed with easily and quickly assemblable and disassemblable panels which does not require any particular piece or tool. Such a bed may futhermore have sliding side panels and a matress support adjustable in height.

It should be understood that the present invention is not limited to the particular embodiments described and that this invention includes all modifications and equivalences which fall within the scope of the appended claims.

What is claimed is:

1. A dismountable bed, in particular for children, comprising:

an upright head panel at one end;

an upright foot panel at the other end;

two side panels interconnecting opposite sides of said head and foot panels;

each of said head and foot panels comprising two vertical posts and a cross-piece disposed between said posts, the side edges of said cross-piece being, at least at some location therealong, spaced from said posts defining an interval therebetween, each of said side panels including at each of their lateral ends at least two tips adapted to engage said vertical posts, each of said tips comprising means for preventing disengagement of said side panel tips with said posts when the angle of the dihedral formed by the planes of said side panel and the adjacent head or foot panel is substantially equal to 90°, and for allowing disengagement when the angle is substantially different from 90°, said means comprising a recess in said tip for engaging said vertical post and a lateral aperture through which said vertical post passes into said recess, said aperture facing away from said cross-piece when the bed is in the operative position in which said dihedral angle is substantially 90°; and substantially rectangular, removable mattress support means, located between said head, foot and side panels, for maintaining the bed in the operative position in which said dihedral angle is substantially 90°.

2. Bed according to claim 1, wherein said posts are substantially circular in cross-section and wherein said tips are resilient and are assembled with said posts by resilient clamping.

3. Bed according to claim 1, wherein said tips of said side panels can slide along the vertical posts of said head and foot panels, the height of each side panel being adjustable through resiliently retractable support means provided for supporting said side panels in the high position, stops being further provided to limit the sliding movement of said side panels.

4. Bed according to claim 3, wherein each resiliently retractable support means is a string wire in the form of a right-angled triangle, the small side of which supports the tip of a side panel, said small side being provided to retract in a hole in said post when the large face of the right-angled triangle is pressed against said post.

5. Bed according to claim 1, wherein said support means is adjustable in height by engagement of projections of said mattress support means in supporting elements secured on said head and foot panels at predetermined heights.

6. Bed according to claim 5, wherein said supporting elements are U-shaped elements, the ends of the arms of which are provided with lateral projections, said supporting elements being provided to be manually hooked or unhooked on the foot and head panels by resiliently deforming the supporting element, and moving the side projections of said element in or away from holes provided in the posts and in the cross-piece, the posts and the cross-piece having several vertically spaced pairs of such holes.

* * * * *